US007071435B2

(12) United States Patent
Altmann

(10) Patent No.: US 7,071,435 B2
(45) Date of Patent: Jul. 4, 2006

(54) TOGGLE SWITCH AND METHOD FOR MANUFACTURING A TWO-STAGE TOGGLE SWITCH

(75) Inventor: Markus Altmann, Moos (DE)

(73) Assignee: TRW Automotive Electronics & Components GmbH & Co. KG, Radolfzell (DE)

( * ) Notice: Subject to any disclaimer, the term of this patent is extended or adjusted under 35 U.S.C. 154(b) by 211 days.

(21) Appl. No.: 10/931,175

(22) Filed: Aug. 31, 2004

(65) Prior Publication Data

US 2005/0051413 A1 Mar. 10, 2005

(30) Foreign Application Priority Data

Sep. 5, 2003 (DE) ..... 103 41 101

(51) Int. Cl.

| | |
|---|---|
| ***H01H 3/00*** | (2006.01) |
| ***H01H 11/00*** | (2006.01) |
| ***H01H 13/02*** | (2006.01) |
| ***H01H 23/00*** | (2006.01) |

(52) U.S. Cl. ..... 200/339; 29/622; 200/329; 200/341; 200/517; 200/520; 200/553; 200/557

(58) Field of Classification Search ..... 200/1 R–1 TK, 200/329–345, 512–517, 520–536, 52 R–61.93, 200/553–572; 29/622; 264/138–163, 239–339
See application file for complete search history.

(56) References Cited

U.S. PATENT DOCUMENTS

| | | | | | |
|---|---|---|---|---|---|
| 4,782,200 | A | | 11/1988 | Oba | |
| 4,877,925 | A | * | 10/1989 | Kobayashi | 200/343 X |
| 4,967,467 | A | * | 11/1990 | Udagawa | 29/622 |
| 5,115,108 | A | | 5/1992 | Ogawa et al. | |
| 5,130,506 | A | * | 7/1992 | Zuercher et al. | 200/553 |
| 5,332,874 | A | * | 7/1994 | Orr et al. | 200/5 B |
| 5,508,479 | A | * | 4/1996 | Schooley | 200/339 X |
| 5,584,380 | A | | 12/1996 | Naitou | |
| 5,703,625 | A | * | 12/1997 | Snider et al. | 345/168 |
| 5,753,874 | A | | 5/1998 | Kossakowski | |

FOREIGN PATENT DOCUMENTS

| | | |
|---|---|---|
| DE | 3629723 | 7/1989 |
| DE | 4104572 | 9/1993 |
| DE | 19600657 | 4/1997 |
| EP | 1081730 | 3/2001 |
| EP | 1294001 | 3/2003 |

* cited by examiner

*Primary Examiner*—James R. Scott
(74) *Attorney, Agent, or Firm*—Tarolli, Sundheim, Covell & Tummino L.L.P.

(57) ABSTRACT

A toggle switch has a switching rocker having at least one arm and one guide plate that has at least one receptacle, in which at least one activation push rod is movably guided in a linear fashion. The arm of the switching rocker can exert a force on the activation push rod. A switching unit is provided, on which the activation push rod can act so as to close an electrical contact. The guide plate and the activation push rod each have a break line, along which, before the assembly of the toggle switch, they were joined to each other in an integral fashion.

13 Claims, 4 Drawing Sheets

TOGGLE SWITCH AND METHOD FOR MANUFACTURING A TWO-STAGE TOGGLE SWITCH

FIELD OF THE INVENTION

The present invention relates to a toggle switch and to a method for manufacturing a toggle switch, in particular a two-stage toggle switch.

BACKGROUND OF THE INVENTION

Toggle switches are known in which the rocking or rotational motion of a switching rocker is converted into a linear motion for closing one or more electrical contacts.

BRIEF SUMMARY OF THE INVENTION

The object of the present invention is to provide a cost-effective toggle switch that assures a reliable switching action.

This is achieved in a toggle switch having a switching rocker that has at least one arm and one guide plate that has at least one receptacle, in which at least one activation push rod is movably guided in a linear fashion. The arm of the switching rocker can exert a force on the activation push rod. A switching unit is provided, on which the activation push rod can act so as to close an electrical contact. The guide plate and the activation push rod each have a break line, along which, before the assembly of the toggle switch, they were joined to each other in an integral fashion.

As a result of the guidance of the activation push rod in the receptacle of the guide plate, a purely linear force action on the switching unit is assured. At the same time, the assembly expense of the activation push rod is extremely small, which is advantageous especially when a plurality of activation push rods are used, because they do not have to be inserted into the receptacle individually but rather can be pressed into the receptacles before or during the assembly of the toggle switch. This can be done by machine.

Before detaching the activation push rod from the guide plate, the guide plate and the activation push rod are preferably joined to each other by at least one web arranged on a lower end of the activation push rod, seen in the switching direction, and an upper end of a wall of the receptacle, likewise seen in the switching direction, in each case with reference to the direction of motion of the activation push rods. Preferably, two webs are provided for each activation push rod. The activation push rods, in a projection into the plane of the guide plate, are therefore already arranged in their desired position. In response to a force action in the direction of the receptacle, they are automatically positioned correctly. A unit of this type can be manufactured simply in an injection molding process.

The receptacle of the guide plate advantageously has a recess in a region of the web, which is configured such that the remainder of the web does not come into contact with a wall of the receptacle. Similarly, the activation push rod in the region of the web can have a recess which is configured such that the remainder of the web does not come into contact with the activation push rod. As a result, it is assured that the remainder of the web does not hinder the motion of the activation push rod in the receptacle. At the same time, using the wall of the receptacle outside of the recess, it is possible to provide a guide that is virtually free of play.

Preferably, a limit stop is provided on an upper end of the activation push rod, viewed in the switching direction, which can also be manufactured as an integral part of the activation push rod. This limit stop prevents the activation push rod from penetrating too far into the guide plate.

In addition, at a lower end of the activation push rod, a latching element can be provided, which, after the activation push rod has been pushed into the receptacle, forms a limit stop for the lower end of the activation push rod and thus secures the activation push rod against falling out of the guide plate.

It is preferable to provide a plurality of activation push rods, which are arranged in corresponding receptacles and which are associated with a corresponding number of switching units.

If a plurality of activation push rods is provided, then a connecting element can be provided, which connects the activation push rods at their upper ends. The upper end of the activation push rods is preferably rounded, and the connecting element rests on the upper ends. Thus the connecting element can perform a rocking motion, by which the differences in level between a depressed activation push rod and one that is in a non-activated position can be equalized.

Different switching points for the different switching units can be realized simply in that the arm of the switching rocker acts upon the connecting element offset from the center between two activation push rods. Due to the effective ratio of the lever arms, the sequence in which the switching units will be activated is clearly predetermined.

In this way, it is possible to realize, e.g., a two- or four-stage toggle switch for an electrical window lift of a vehicle. On the basis of a tilting motion in two directions, it is possible to actuate, for example, four switching stages. For a four-stage switch, the switching rocker preferably has two arms. Each of the two arms, e.g., via one or a plurality of connecting elements that rests on the upper ends of the activation push rods, can depress two activation push rods and therefore realize two switching states.

The present invention further relates to a method for manufacturing a toggle switch. In this context, the guide plate and the activation push rod are manufactured as one integral piece, and the activation push rod, as a result of a force action, is pressed into the receptacle of the guide plate and in this manner is detached from the guide plate.

The guide plate and the activation push rod are preferably manufactured in one piece from a suitable plastic in an injection molding process.

DETAILED DESCRIPTION OF A PREFERRED EMBODIMENT

Figure 1:
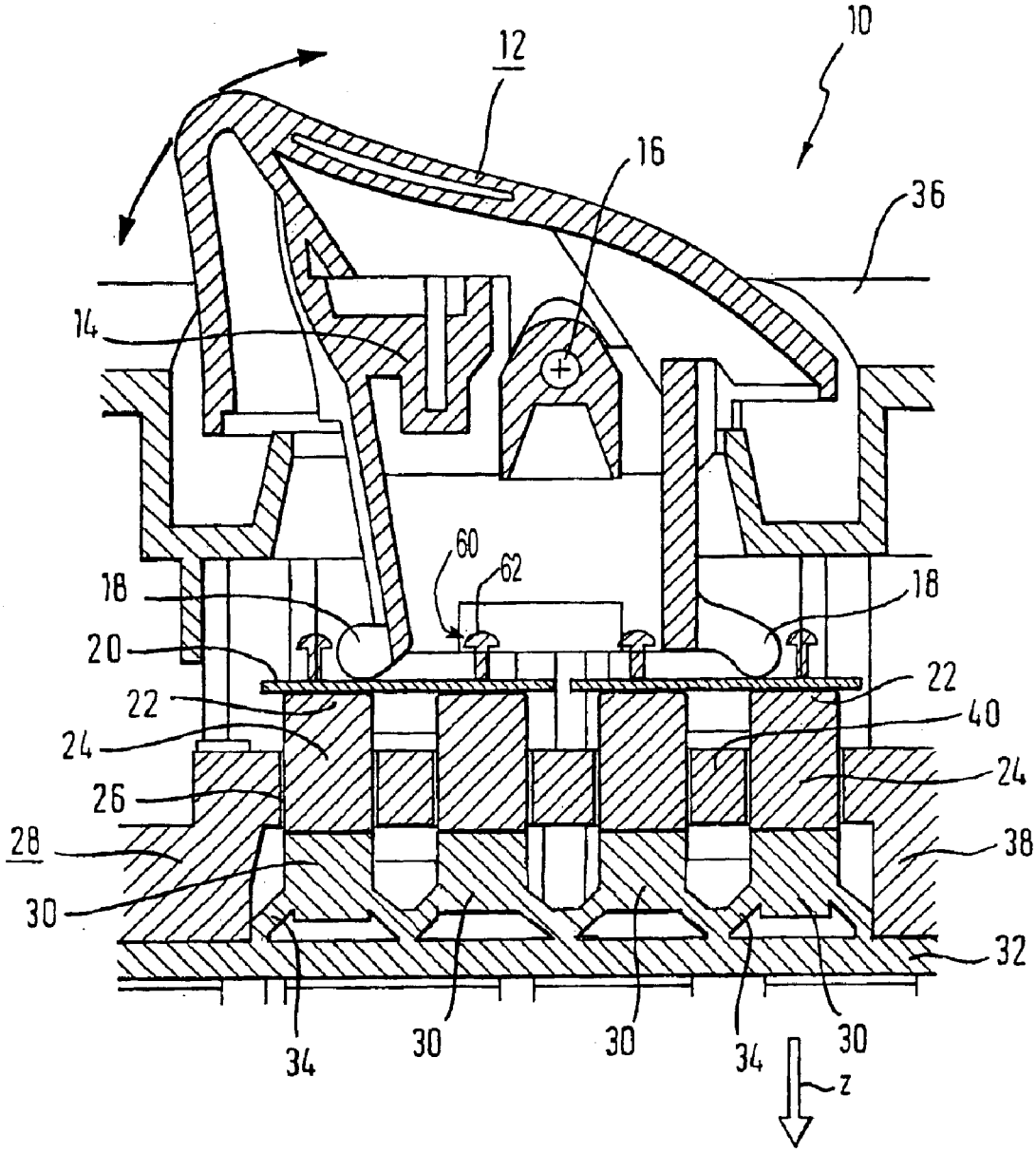
FIG. 1 shows a schematic sectional view of a toggle switch according to the present invention.

FIG. 1 shows a toggle switch 10 having a switching key 12, which is connected to a two-arm switching rocker 14.

Switching rocker 14 can be tilted in two directions about an axis 16, which is illustrated in FIG. 1 by the two arrows. This rocking motion, as will be described below, is converted into a linear motion in a switching direction z, which results in closing one or more electrical contacts.

Each of the two arms 18 of switching rocker 14 rests on a singular connecting element 20, which here is made from a sheet metal. Connecting element 20 in turn rests on rounded upper ends 22 (with regard to switching direction z) of activation push rods 24. Each activation push rod 24 is guided in a receptacle 26 of a guide plate 28. The receptacles 26 permit only a linear motion of the activation push rods 24 in switching direction z, designated in FIGS. 1 and 2 with an arrow, as well as in the opposite direction. On the side facing away from the connecting element 20, the lower ends of the activation push rods 24 are in contact with switching units, which here are formed by switch domes 30 of a conventional switch mat 32. An electrical contact is closed, when a switch dome 30 through a contact on its lower side touches a corresponding opposite contact on the base of switch mat 32 (not shown). Switch domes 30 are connected via elastic connections 34 to the base of the switch mat 32 and are elastically biased such that they are urged to return to the open position indicated in FIG. 1.

The guide plate 28 has a central planar section 40 and spacer sections 38 on the exterior sides extending in the direction of switch mat 32.

The tipping or rotating motion of switching key 12 is converted into a purely linear motion via the connecting element 20 and the activation push rods 24, which are guided in receptacles 26, so that the switch domes 30 are always loaded only in z-direction.

The toggle switch 10 is shown in FIG. 1 in a non-activated position. There, the switching rocker 14 is in balance, so that neither of the activation push rods 24 is loaded and shifted from its illustrated initial position. Neither of the switch domes 30 is depressed, so that all electrical contacts of the switch mat 32 are open. To prevent a rattling, however, each switch dome 30 is biased by roughly 0.2 mm. Switching rocker 14 and activation push rods 24 are as a rule slightly biased.

The depicted toggle switch 10 is a four-stage switch, such as can be used, e.g., for an electrical window lift of a vehicle. In this case, only the upper part of switching key 12 would extend beyond a lining part 36 of the vehicle, e.g., a door cladding.

The arms 18 of the switching rocker 14 rest on the connecting element 20, offset in each case from the center between two activation push rods 24, so that the activation forces for the two corresponding switch domes 30 are different. Via the contact point of the arms 18 on the connecting element 20, the force necessary for triggering the different switching states can be adjusted.

In response to depressing switching key 12 in accordance with a first indicated arrow direction, a force is initially exerted on the activation push rod 24 depicted in FIG. 1 at the far left, and therefore on the switch dome 30, which is assigned to this activation push rod 24, so that this contact is the first to be closed, in the case that the activating forces of all switch domes 30 are the same. If a stronger force is exerted in the same direction, then the activation push rod 24 that is situated in FIG. 1 to the right next to the activation push rod 24 that was first depressed, is depressed until the corresponding electrical contact is likewise closed. It happens analogously when the switching key 12 is pulled in the other indicated arrow direction. In this case, the first closed contact is the one situated to the far right.

As a result of the rounding of the upper ends 22 of the activation push rods 24, the connecting element 20 can adjust in its position if one or more activation push rods 24 have been depressed into their receptacle 26 to close the electrical contacts.

In the following, the manufacturing process for toggle switch 10 is discussed in greater detail.

Figure 2:
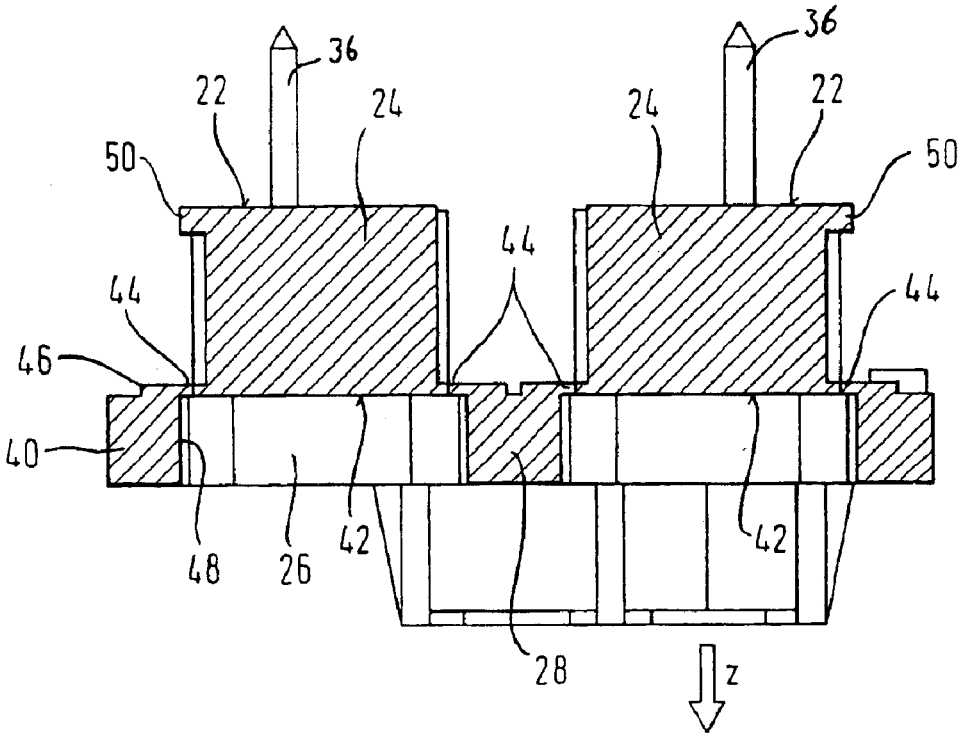
FIG. 2 shows a schematic sectional view of a unit made up of a guide plate and two activation push rods for use in a method according to the present invention for manufacturing a toggle switch after the manufacture of the unit.

The guide plate 28 and the activation push rods 24 are manufactured as an integral unit in an injection molding process. This unit is depicted in FIG. 2. The activation push rods 24 are connected at a lower end 42 on two sides to an upper end 46 of a wall 48 of the receptacle 26 in the guide plate 28 via webs 44 formed in one piece with the activation push rods 24 and the guide plate 28.

Figure 3:
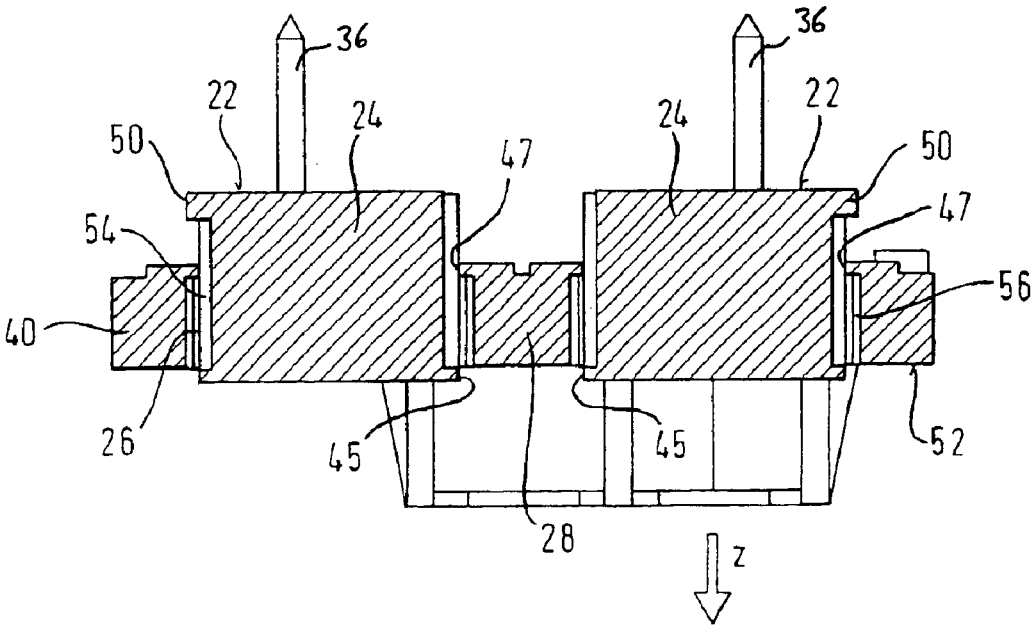
FIG. 3 shows the unit in FIG. 2 after the activation push rods have been pressed into the receptacles of the guide plate.
Figure 4:
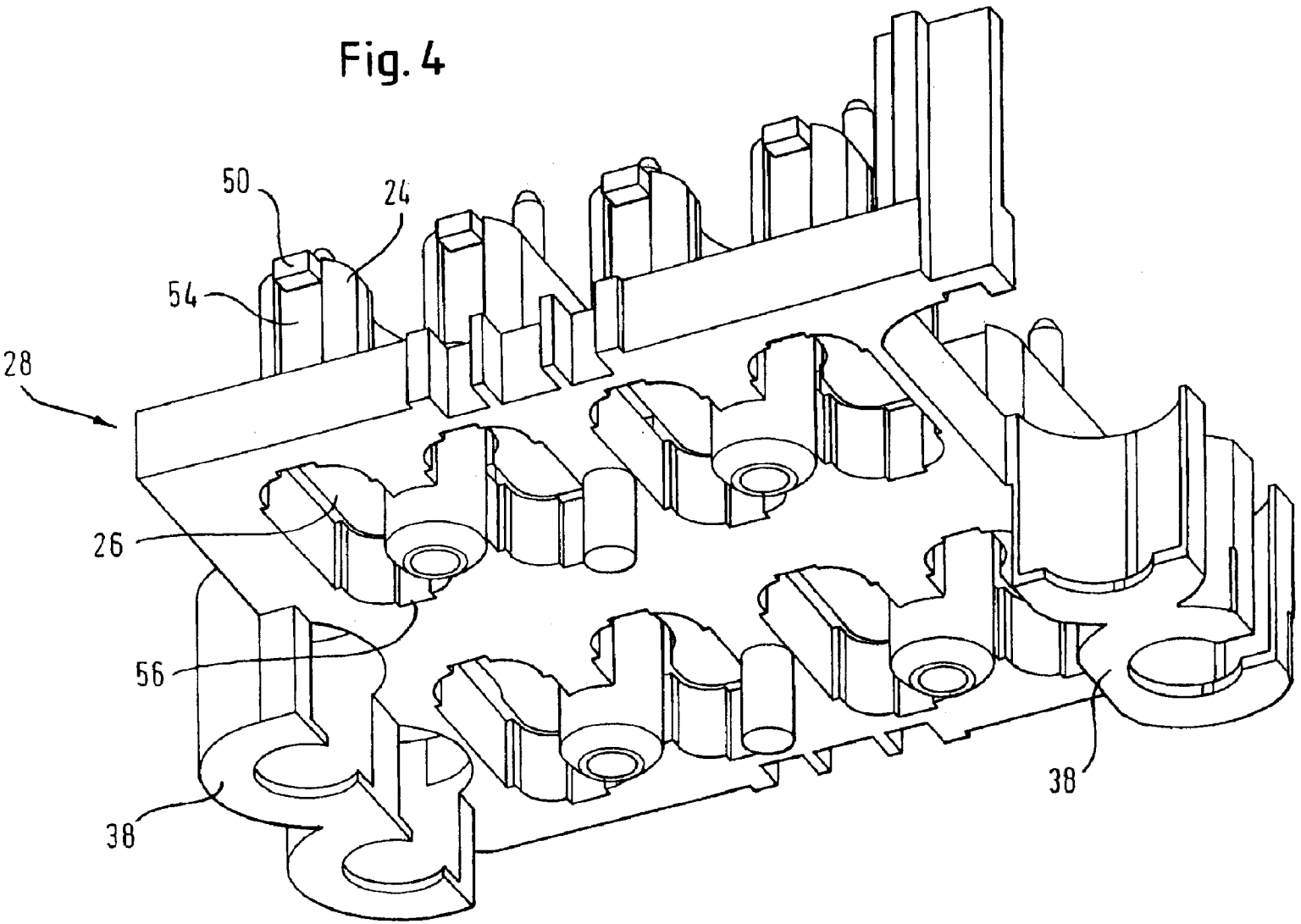
FIG. 4 shows the unit in FIG. 2 in a schematic perspective view.
Figure 5:
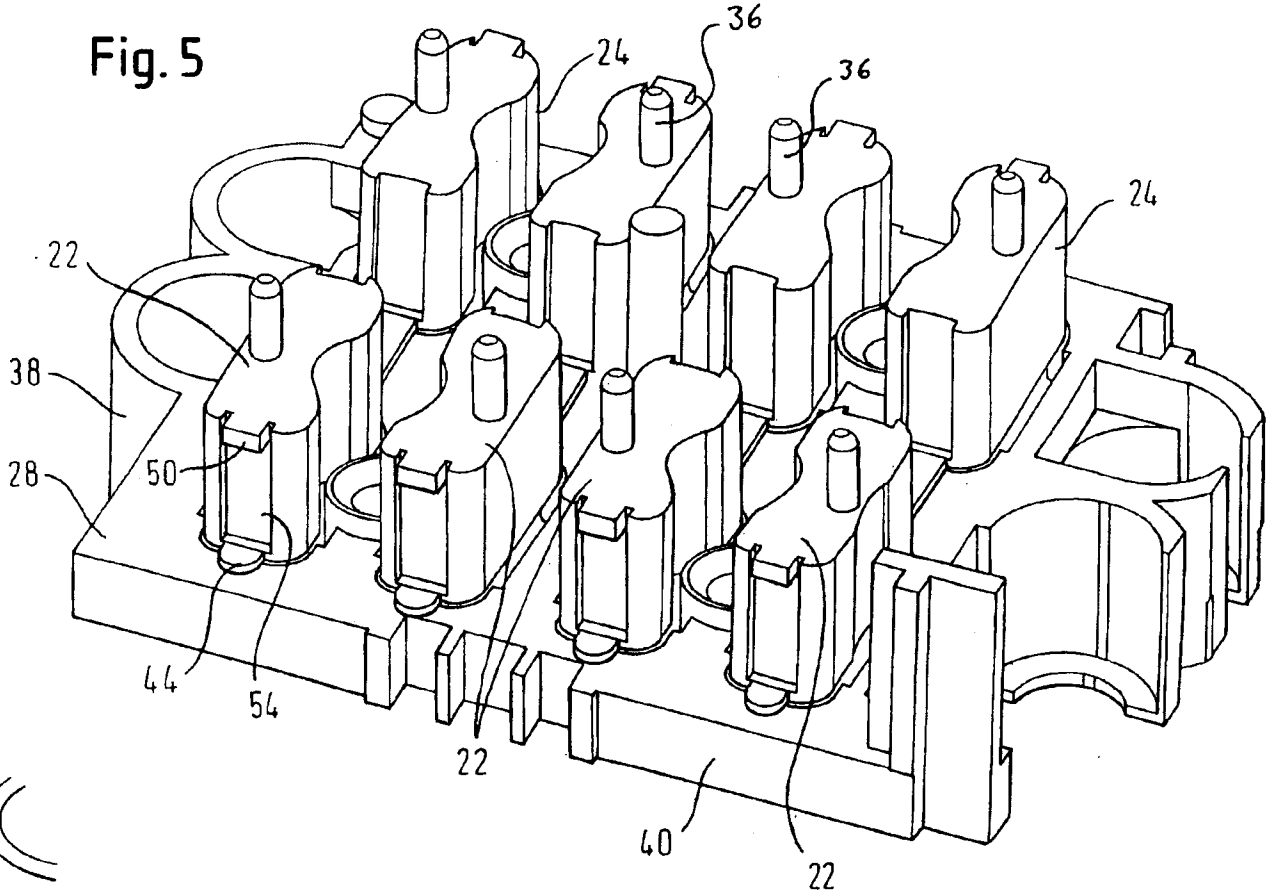
FIG. 5 shows the unit in FIG. 2 and a further schematic perspective view.
Figure 6:
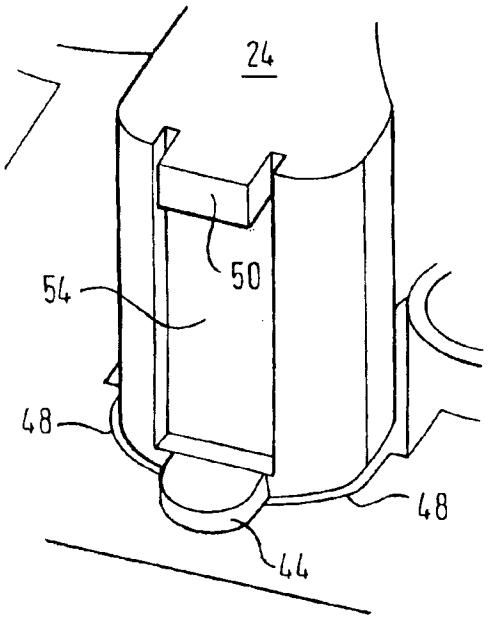
FIG. 6 shows an enlarged detail in FIG. 5.

After the manufacture of the unit made up of guide plate 28 and activation push rods 24, a force in z-direction is acted upon the activation push rods 24, and all activation push rods 24 are pressed into the corresponding receptacles 26 at the same time. This can occur, e.g., through the use of a lever press. During this process the webs 44 break on break lines 45, 47. After this process, the activation push rods 24 are movably guided in z-direction in the receptacles 26, as shown in FIG. 3. Each activation push rod 24 has a limit stop 50 at its upper end 22, which prevents the activation push rod 24 from sliding too deeply into the receptacle 26 in the z-direction. In addition, each activation push rod 24 has a latching element (not shown here) at its lower end 42, which, after being pressed into receptacle 26, comes into contact with a lower side 52 of the planar section 38 of the guide plate 28 and prevents a motion of the activation push rod 24 in the direction opposite to switching direction z, which could lead to its slipping out of receptacle 26. The activation stroke determined by the limit stop 50 and the latching element is sufficient for depressing the switch domes 30.

In the region of the webs 44, provision is made for recesses 54, 56 both on the activation push rods 24 as well as on the receptacles 26. These recesses 54, 56 prevent break lines 45, 47 from coming into contact with the activation push rod 24 or the wall 48 of the receptacle 26. The activation push rods 24 lie against the wall 48 of the receptacles 26 with the exception of the recesses 54, 56.

When the activation push rods 24 are pushed into the receptacles 26, the latching elements on the lower ends of the activation push rods 24, not shown here, also engage with the lower side 52 of the guide plate 28.

On the upper end 22 of each activation push rod 24 a pin 60 formed in one piece with the activation push rod 24 is provided. The pins 60 extend through corresponding openings in the connecting element 20 and attach the connecting element 20 to the activation push rods 24.

After the connecting element 20 is placed on the activation push rods 24, the upper, free end of each pin 60 is formed under heat treatment into a mushroom-shaped head 62, to prevent the connecting element 20 from detaching from the activation push rods 24. The distance between the head 62 and the connecting element 20 is chosen such that a tilting movement of the connecting element 20 with respect to the upper ends 22 of the activation push rods 24 is still allowed.

What is claimed is:

1. A toggle switch having a switching rocker (14) that has at least one arm (18), a guide plate (28) having at least one receptacle (26), in which at least one activation push rod (24) is guided so as to be movable in a linear manner, said arm (18) of said switching rocker (14) being able to exert a force on said activation push rod (24), and a switching unit (30, 32), on which said activation push rod (24) can act in order to close an electrical contact, said guide plate (28) and said activation push rod (24) each having a break line (45, 47), along which they are joined to each other in an integral fashion before the assembly of said toggle switch (10).

2. The toggle switch according to claim 1, wherein, before an detachment of said activation push rod (24) from said guide plate (28), said guide plate (28), and said activation push rod (24) are joined to each other by at least one web (44), which is arranged on a lower end (42) of said activation push rod (24) and an upper end (46) of a wall (48) of said receptacle (26).

3. The toggle switch according to claim 2, wherein two webs (44) are arranged on said activation push rod (24).

4. The toggle switch according to claim 2, wherein said receptacle (26) of said guide plate (28) has a recess (56) in a region of said web (44), which is configured such that an remainder of said web (44) cannot come into contact with said wall (48) of said receptacle (26).

5. The toggle switch according to claim 2, wherein said activation push rod (24) has a recess (54) in a region of said web (44), which is configured such that the remainder of said web (44) cannot come into contact with said activation push rod (24).

6. The toggle switch according to claim 1, wherein on an upper end (22) of said activation push rod (24) a limit stop (50) is provided.

7. The toggle switch according to claim 1, wherein at least two activation push rods (24) are provided.

8. The toggle switch according to claim 7, wherein at least one connecting element (20) is provided, which connects said activation push rods (24) at their upper ends (22).

9. The toggle switch according to claim 8, wherein said upper end (22) of each activation push rod (24) is rounded, and said connecting element (20) rests on said upper ends (22).

10. The toggle switch according to claim 8, wherein said arm (18) of the switching rocker (14) acts upon said connecting element (20) offset from a center between two activation push rods (24).

11. The toggle switch according to claim 1, wherein said switching rocker (14) has two arms (18).

12. A method for manufacturing a toggle switch according to claim 1, wherein said guide plate (28) and said activation push rod (24) are manufactured as one integral piece, and said activation push rod (24) is pressed by a force action into said receptacle (26) of said guide plate (28) and is thereby detached from said guide plate (28).

13. The method for manufacturing a toggle switch according to claim 12, wherein said guide plate (28) and said activation push rod (24) are manufactured in one piece in an injection molding process.

* * * * *